United States Patent [19]

Wright et al.

[11] Patent Number: 5,071,326

[45] Date of Patent: Dec. 10, 1991

[54] DOUBLE PISTON PORTIONING APPARATUS

[75] Inventors: William R. Wright; Richard G. Powers; Wendell E. Dennis, all of Overland Park; James E. Anderson, Prairie Village, all of Kans.; Kevin F. Cooper, Lee's Summit, Mo.

[73] Assignee: Marlen Research Corporation, Overland Park, Kans.

[21] Appl. No.: 597,049

[22] Filed: Oct. 15, 1990

[51] Int. Cl.[5] ..... F04B 7/00; F04B 39/10

[52] U.S. Cl. ..... 417/517; 452/35; 452/31

[58] Field of Search ..... 92/13, 13.3; 417/318, 417/517; 452/40, 41, 42, 35, 30

[56] References Cited

U.S. PATENT DOCUMENTS

| | | | |
|---|---|---|---|
| 859,192 | 7/1907 | Barber | 452/42 |
| 1,636,424 | 7/1927 | Lutostanski | 452/42 |
| 2,376,838 | 5/1945 | Walter | 452/35 |
| 2,876,704 | 3/1959 | Collion | 417/318 |
| 4,580,954 | 4/1986 | Boyle | 417/517 |

*Primary Examiner*—Richard A. Bertsch
*Assistant Examiner*—Peter Korytnyk
*Attorney, Agent, or Firm*—Hovey, Williams, Timmons & Collins

[57] ABSTRACT

Apparatus (20) for successively supplying substantially equal portions of a flowable comminuted product such as sausage from a source thereof to a delivery zone is disclosed wherein dual product portioning chambers (80, 88, 82, 90) are provided which function such that as meat to be portioned is directed into a first chamber which increases in volume to a predetermined extent, portioned meat is delivered from the other chamber as it decreases in volume to the same predetermined extent. Means (114) is provided externally of the chambers for substantially equalizing the increase and decrease of the effective product-receiving volume of each of the chambers.

16 Claims, 8 Drawing Sheets

SUPPLY
FIL
LUB
PSI
REG
AND
OR
CLIP SIGNAL
VENT
OFF
MANUAL
AUTO
DOWN
UP

DOUBLE PISTON PORTIONING APPARATUS

BACKGROUND OF THE INVENTION

1. Field of the Invention

This invention relates to apparatus and a method for successively supplying substantially equal portions of a flowable product from a source thereof to a delivery zone. Specifically, the invention concerns a double piston portioning machine for delivering precise portions of a flowable product such as comminuted meat to a packaging zone. One particular use of the apparatus, for example, is to stuff a product such as sausage in casings where the sausage of an advertised fixed weight is then to be sold at a specific retail price.

2. Description of the Prior Art

In the processing of food items such as sausages and other comminuted meat products, control over the size, shape and weight of the retail product are all of importance. Shape can often be controlled by the way in which the product is delivered to the packaging area. For example, extruders have been employed for some time to deliver the ground meat to a casing which is slipped over the extruder outlet tube or horn. The weight of each individual encased sausage thus becomes primarily a function of the amount of meat delivered to each casing placed over the delivery horn.

Certain retailers, and particularly those that sell high volumes of sausage in casings, often establish a fixed price for a particular size of the sausage. This is especially true as to sausages that are sold as a variety pack retailed at certain seasons of the year as gifts. Similarly, high volume retailers will often offer cased sausages at a fixed price for a designated size, such as three pounds, rather than on an actual per ounce basis. In instances such as these, the meat processor must furnish to its customers a packaged meat product which weighs at least as much as the advertised weight sold at the fixed price. The standard established therefor is a fixed weight as a minimum with all tolerances being on the plus side and therefore to the benefit of the customer. Using the three-pound encased sausage product as an example, the sausage must weight at least three pounds under all circumstances and any variations encountered during processing and packaging must be on the three pounds plus side.

The fixed price product being one that is sold in large volumes, it is also essential that processing machinery be available which will automate the packaging process to the extent possible and minimize direct labor costs.

Previously, processors have determined that they must establish an overage tolerance of at least about 3.5 grams if they are to assure delivery of a three-pound package in all instances. It can therefore be seen that if the overall plus tolerance standard can be reduced to 2.5 grams, the savings to the processor may amount to as much as 30% of the prior unbilled overage.

Meat portioners for delivering a product such as sausage to a casing packaging area have included dual piston machines wherein opposed cylinders have a rod extending therethrough joining respective pistons so that the pistons move in tandem. In this manner, as one piston moves away from the central zone therebetween, the other piston moves toward such zone and vice versa. Thus, delivery of comminuted meat to one cylinder causes the piston therein to move away from the central delivery zone as meat previously supplied to the other cylinder is forced out of its cylinder to the extrusion horn where it may be directed into a sausage casing or the like.

Although the dual piston machine having a central connecting rod for the pistons extending through the cylinders did have some advantages in connection with portioning of the meat into individual segments of essentially the same size, the construction of the machines was such that cleaning of the components was very difficult, the portioning accuracy was compromised by the nature of the machine construction, and product throughput was somewhat limited by the mechanical arrangement employed.

SUMMARY OF THE INVENTION

The meat portioning apparatus of this invention also embodies two opposed, axially aligned piston and cylinder assemblies which are connected to a central rotor compartment. A rotor in the compartment has passages therein which alternately communicate a comminuted meat supply with first one cylinder and then the other, and to communicate the cylinders with a delivery tube or horn. The pistons in respective cylinders are interconnected by elongated rods disposed externally of the cylinders so that movement of one piston causes a concomitant, correlated movement of the other piston in the same direction.

As a consequence, when meat is directed into one of the cylinders via the central rotor, that meat entering the cylinder causes the piston therein to move away from the rotor as the volume of the chamber presented by the cylinder and its piston increases. At the same time, the external connector rods which join the pistons cause a corresponding movement in the same direction of the piston in the other cylinder to decrease the volume of such cylinder. The result is that as comminuted meat such as sausage is diverted into one of the cylinders by the rotor to effect shifting movement of the piston by virtue of the pressure of the meat product thereon, the opposite piston is forced toward a volume decreasing position by virtue of the external mechanical connection between the pistons. This causes meat that has been previously conveyed to the other cylinder to be ejected therefrom and delivered via the central control rotor to the packaging zone.

An especially important feature of the invention is the fact that the mechanism external of the cylinders for joining the pistons thereof includes structure that allows the relative spacing between the pistons to be selectively varied by the operator of the machine while the portioner is in full operation, thus negating the necessity of shutting the machine down for portion adjustment purposes.

Another important feature of the invention is the provision of a portioner which may be operated in a manual mode where shifting of the pistons to deliver exact portions of comminuted meat to the packaging area is under the full control of the operator of the machine, or an automatic mode activated whereby meat is automatically delivered in exact portions at periodic intervals to a packaging zone.

A still further important feature of the portioner is the fact that the operative product portioning and delivery components of the machine may readily be disassembled on a daily or even more frequent basis for cleaning of such components to meet applicable sanitary requirements and codes.

DETAILED DESCRIPTION OF THE PREFERRED EMBODIMENT

Figure 1:
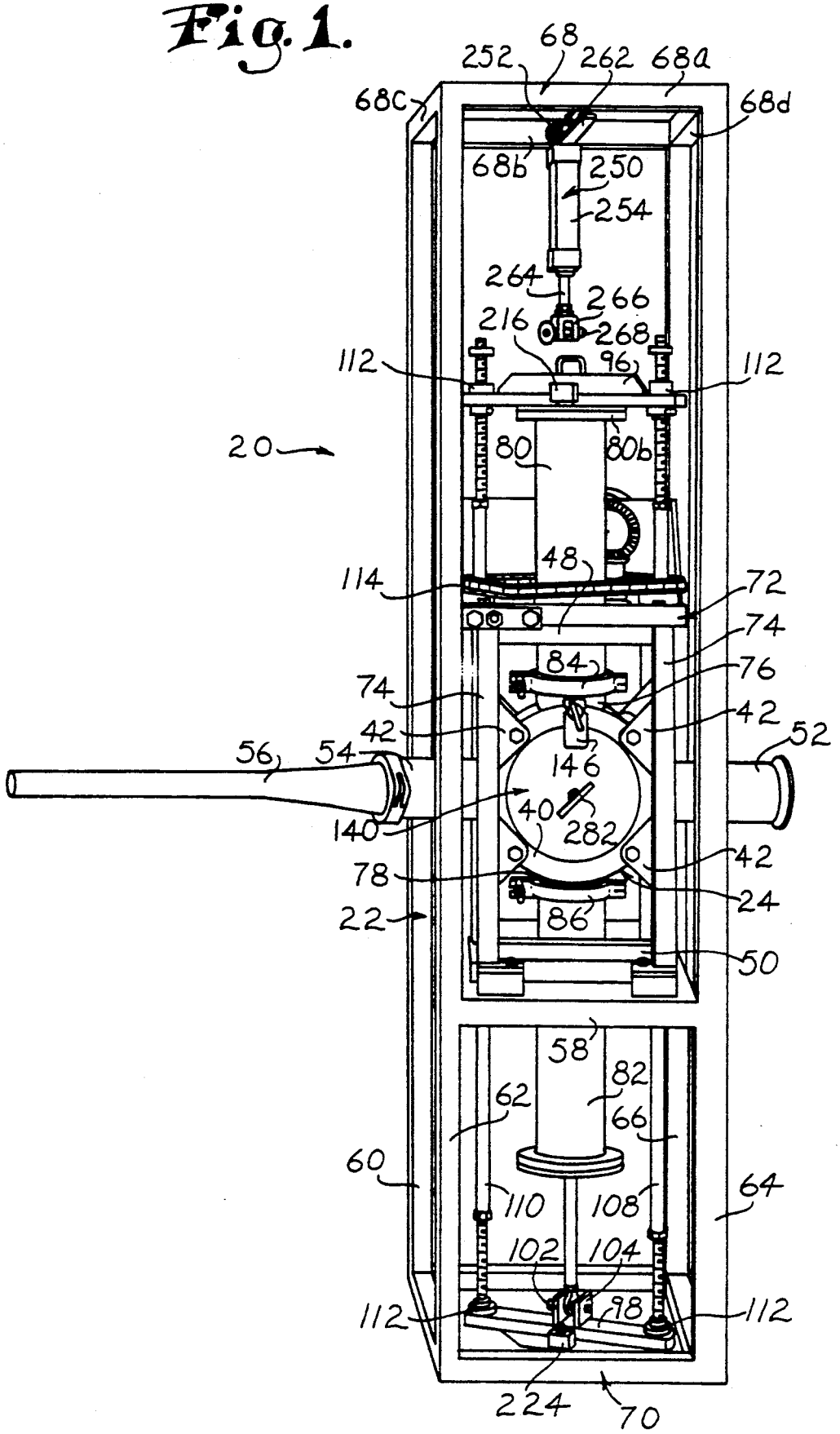
FIG. 1 is a front perspective view of portioning apparatus in accordance with a preferred embodiment of the invention, with the cover panels and supporting wheels removed for clarity.

Viewing FIG. 1, the portioning apparatus 20 shown without closure doors on the four sides thereof, or wheels which facilitate mobility of the machine, has an upright rectangular frame broadly designated 22. The generally cylindrical central compartment 24 is made up of a cylinder 26 (FIG. 2) disposed with its axis located horizontally and extending fore and aft of the machine. A rear circular plate 28 welded to the rear annular edge of cylinder 26 is bolted to gussets 30 on upright members 32 and 34 which extend between upper and lower cross members 36 and 38.

An annular flange 40 is welded to the circular edge of cylinder 26 opposite plate 28 and is bolted to gussets 42 on the upright frame members 44 and 46, which extend between upper and lower horizontal cross members 48 and 50 (see FIG. 1). A horizontal comminuted, flowable product supply tube 52 is connected to cylinder 26 in radially extending disposition and communicates with the interior of the cylinder. Another product delivery tube 54 extends outwardly from the opposite side of the cylinder 26 and also communicates with the interior thereof. It is to be seen from FIGS. 1, 3 and 4 that the tubes 52 and 54 are in axially aligned relationship. Also as is apparent from FIG. 1, a product delivery casing horn 56 may, if desired, be removably attached to the outer end of the delivery tube 54.

The frame assembly made up of members 32–38 and 44–50 is carried by a horizontal frame unit 58 secured to the four main upright frame members 60, 62, 64 and 66 which are joined at the upper and lower ends thereof by rectangular frame elements 68 and 70. Another horizontal rectangular frame broadly designated 72 is mounted on the upper extremities of frame members 32, 34, 44 and 46. That frame, along with the members 32, 34, 44 and 46 are further braced by the angle members 74 extending upwardly from the frame unit 58 (FIG. 2).

Figure 6:
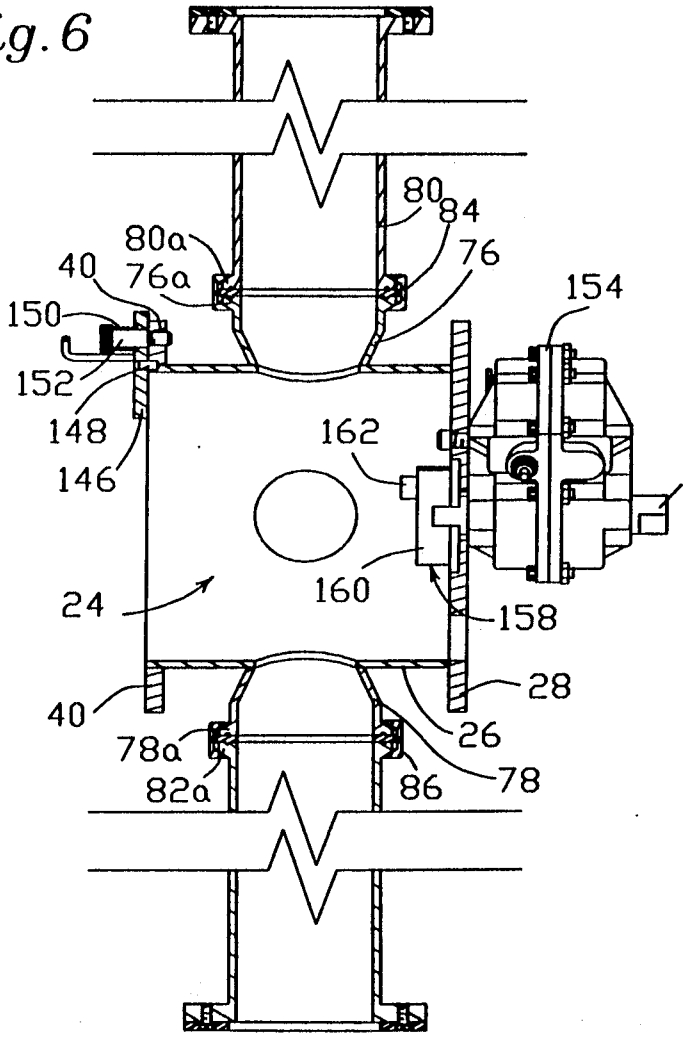
FIG. 6 is an enlarged fragmentary vertical cross-sectional view taken on the line 6—6 of FIG. 5 and looking in the direction of the arrows.

Two tubular sections 76 and 78 respectively welded to the periphery of cylinder 26 in radially extending relationship therefrom, communicate with the interior of cylinder 26 and are axially aligned transversely of the cylinder. Elongated flowable product-receiving cylinders 80 and 82, each of the same diameter as the outermost diameter of sections 76 and 78, are provided with flanges 80*a* and 82*a* respectively on one end of each which are adapted to complementally mate with the flanges 76*a* and 78*a* of tubular sections 76 and 78 projecting from upper and lower surface portions of rotor compartment 24 (FIG. 6). Circular clamp 84 releasably joins the flanges 80*a* and 76*a* of cylinder 80 and section 76 respectively while a similar circular clamp 86 engaging flanges 78*a* and 82*a* of section 78 and tube 82 respectively, releasably couples cylinder 82 to tubular section 78.

A shiftable piston 88 of synthetic resin material is reciprocably mounted within cylinder 80 while a similar synthetic resin piston 90 is shiftably mounted within the cylinder 82. It can be seen from FIG. 2, for example, that the cylinders 80 and 82 as well as the pistons 88 and 90 are of essentially identical construction and therefore are of the same dimensions.

Figure 2:
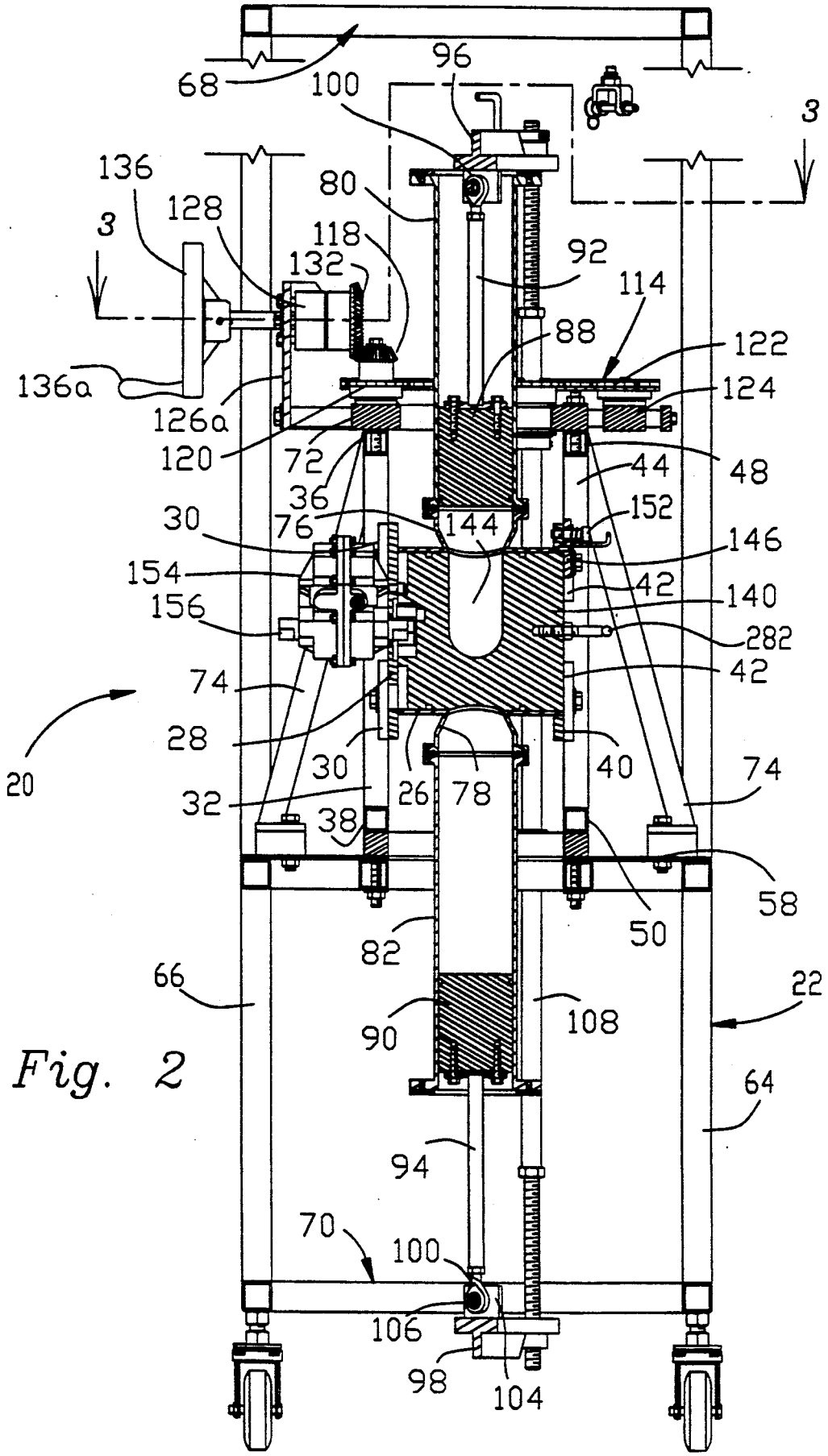
FIG. 2 is an enlarged vertical cross-sectional view through the machine taken on the irregular dash dot line 2—2 of FIG. 3 and looking in the direction of the arrows.

A connecting rod 92 which is secured to the uppermost face of piston 88 remote from compartment 26, extends upwardly within cylinder 80, while a similar rod 94 affixed to the lower end of piston 90 projects downwardly from cylinder 82 as best shown in FIG. 2.

An elongated, transversely T-shaped cross member 96 extends across the open top of cylinder 80 while a similar elongated T-shaped cross member 98 is positioned at the lower part of frame 22 below cylinder 82 (FIGS. 1 and 2). The cross members 96 and 98 are aligned vertically and are each of a length such that the extremities thereof project beyond the confines of cylinders 80 and 82 as well as the cylinder 26 of rotor compartment 24. Opposed extremities of rods 92 and 94 are connected to corresponding cross members 96 and 98 respectively by an eye bolt 100 secured to respective rods 92 and 94. The eye bolts 100 are pivotally connected to upstanding tabs 102 and 104 on each of the rods by a suitable fastener 106.

A pair of adjustment rods 108 and 110 extend between opposed extremities of cross members 96 and 98 outboard of cylinders 80 and 82 as well as the rotor compartment 24. The upper and lower extremities of each of the rods 108 and 110 are oppositely threaded and rotatably received within threaded bearings 112 therefor carried by the ends of cross members 96 and 98. It is to be understood in this respect that by simultaneous rotation of adjustment rods 108 and 110 in the same direction, in either of the directions of rotation thereof, cross members 96 and 98 are caused to move toward and away from one another with a corresponding shifting of pistons 88 and 90 toward and away from each other.

Means for simultaneously rotating rods 108 and 110 includes chain mechanism 114 carried by frame 72 in surrounding relationship to cylinder 80. As is most apparent from FIGS. 2 and 3, chain mechanism 114 includes a sprocket 116 slidably mounted on each of the rods 108 and 110 via appropriate bearings and a conventional key/keyway arrangement (not shown). The respective sprockets and bearings are mounted on and above frame 72 at opposite corners thereof. The key/keyway connection of each of the sprockets 116 to rods 108 and 110 serve to effect rotation of corresponding rods 108 and 110 with a respective sprocket 116 without interferring with vertical movement of the rods 108 and 110 relative to the drive sprockets 116. A bevel gear 118 also rotatably carried by frame 72 at another corner thereof is joined to a sprocket 120 for rotating the latter as the gear 118 is rotated. It is to be seen from FIG. 2, for example, that sprocket 120 is located at the same vertical level as aligned sprockets 116 on rods 108 and 110. Another take-up or idler sprocket 122 is rotatably carried by support structure 124 bolted to the side of frame 72 opposed to gear 118 and sprocket 120.

Figure 3:
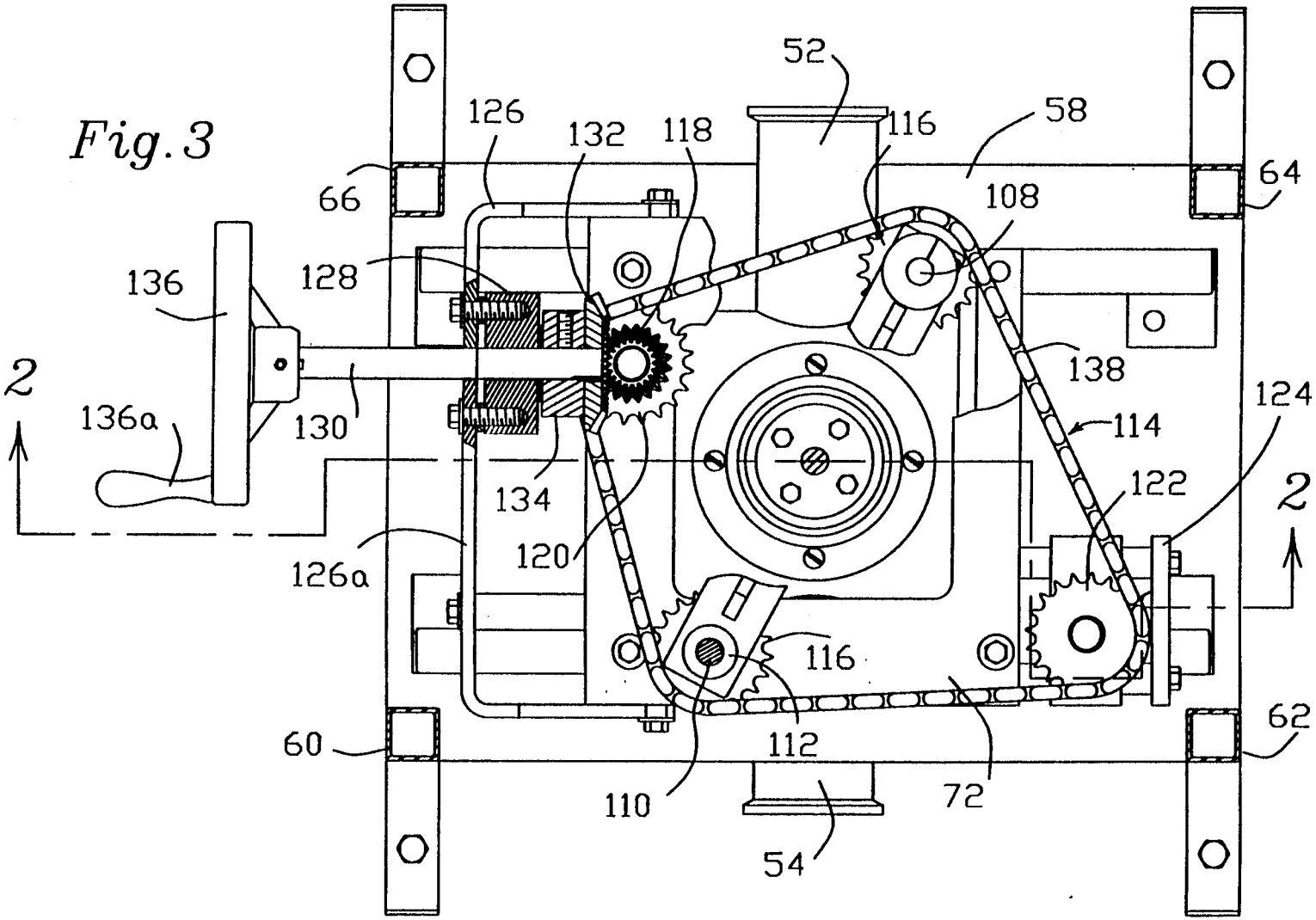
FIG. 3 is an enlarged horizontal cross-sectional view taken substantially on the dash dot line 3—3 of FIG. 2 and looking downwardly.
Figure 4:
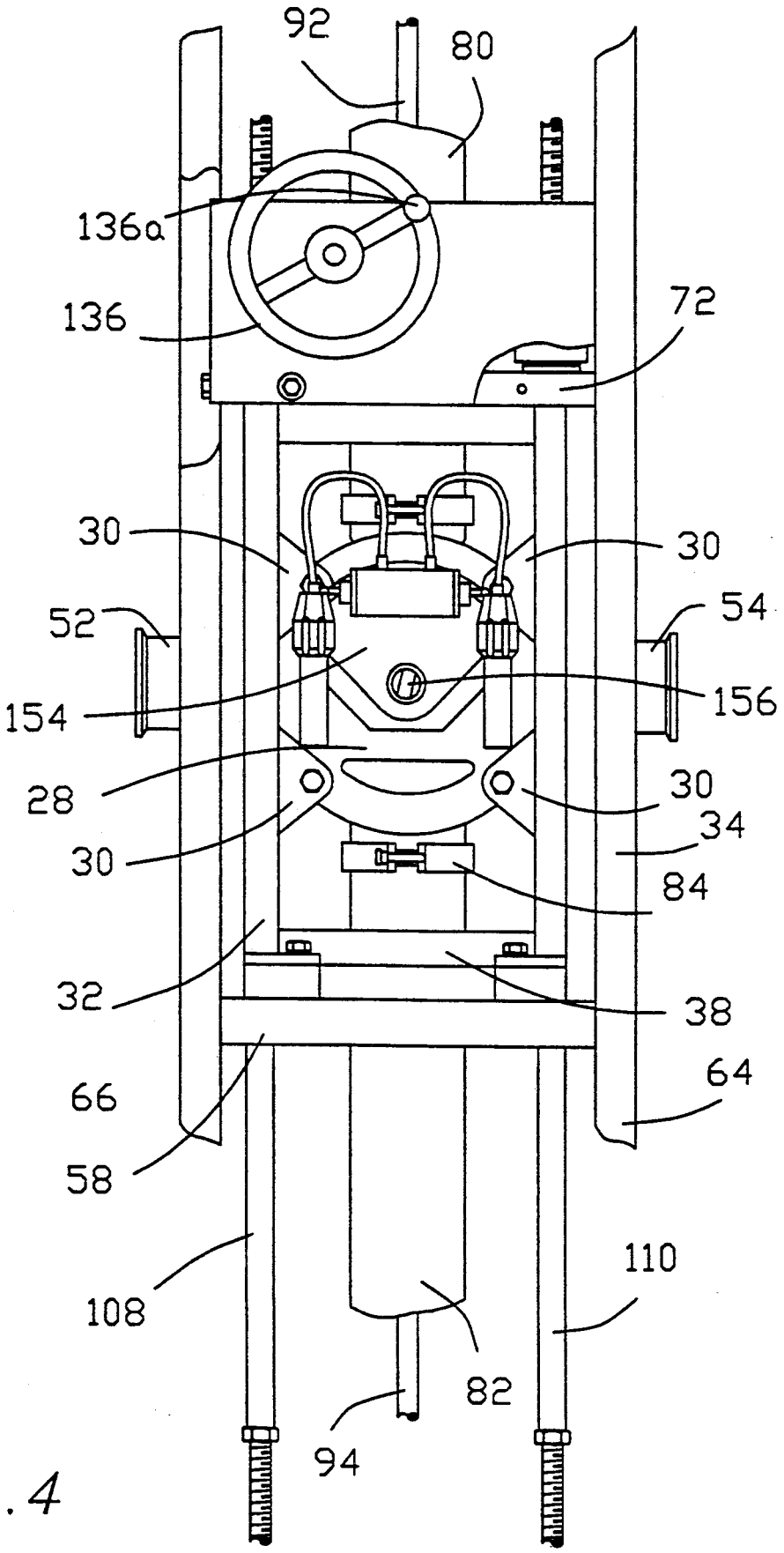
FIG. 4 is a fragmentary rear elevational view of the machine with the rear panel removed.

A horizontally disposed U-frame 126 is bolted to frame 72 on the side thereof carrying bevel gear 118 and sprocket 120 (see FIG. 3). In lieu of the frame 126, a solid block (not shown) could also be used. In any event, frame 126 has an upright bight portion 126*a* which serves to support a bearing 128 rotatably receiving a horizontal shaft 130 which extends inwardly toward bevel gear 118 and projects out from the rear of frame 22 of apparatus 20. A bevel gear 132, pinned to the innermost end of shaft 130 through means such as an extension 134, is in operative meshing engagement with bevel gear 118. Hand wheel 136 secured to the outermost end of shaft 130 facilitates rotation thereof by means of the crank handle 136*a*. An endless link chain 138 is trained around sprockets 116 on rods 108 and 110 respectively as well as sprocket 120 and take-up sprocket 122. The structure 124 mounting sprocket 122 on frame 72 permits in and out movement of the axis of sprocket 122 as necessary to maintain appropriate tautness in chain 138.

Figure 7:
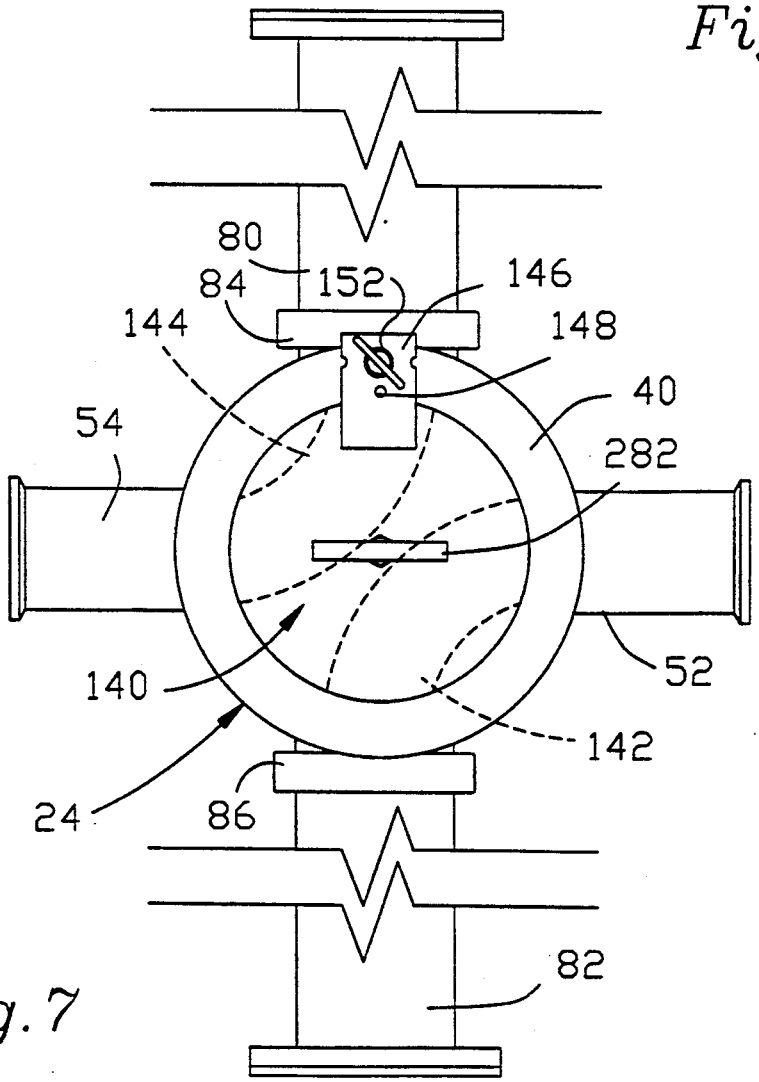
FIG. 7 is an enlarged fragmentary front elevational view similar to FIG. 5 but illustrating the distribution rotor in place within the compartment therefor.

A cylindrical synthetic resin rotor 140 (FIGS. 2, 7 and 8) is removably positioned in compartment 26 and extends from plate 28 to the outermost space of the compartment 24 as represented by the flange 40. Rotor 140 has two arcuate passages 142 and 144 therethrough which extend transversely of the rotor as best depicted in FIG. 7. In one position of rotor 140 the passage 142 communicates supply tube 52 with cylinder 82 via tubular section 78 while the passage 144 communicates the interior of cylinder 80 with delivery tube 54. In the other position of rotor 140 which is 90° out of phase with the first position thereof, the passage 142 communicates the interior of cylinder 82 with delivery tube 54 while passage 144 communicates supply tube 52 with cylinder 80.

A retainer plate 146 pivotally mounted on flange 40 of rotor compartment 24 serves to retain the rotor 140 within cylinder 26 as the rotor is rotated between its two operative positions, but may be turned 90° from the disposition thereof illustrated in FIG. 7 for removal of the rotor from the compartment 24. A pin 148 carried by flange 40 on cylinder 26 (FIG. 6) is normally received within the flange 40 of compartment 24, but when it is desired to remove the rotor 140 from the compartment 24, the plate 146 is pivoted outwardly against the force of a spring 150 surrounding retainer plate mounting member 152 so that the plate 146 may be shifted into rotor clearing disposition. Alternately, use may be made of a single bolt operatively securing plate 146 in position.

Figure 8:
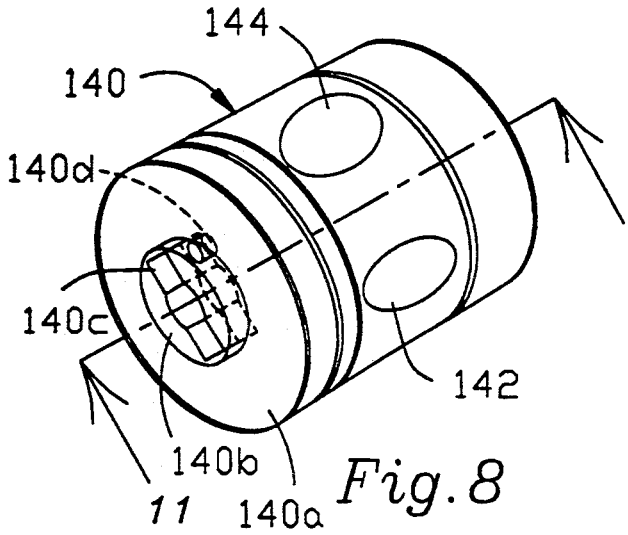
FIG. 8 is an enlarged perspective view of the control distribution rotor depicted in FIG. 7.
Figure 11:
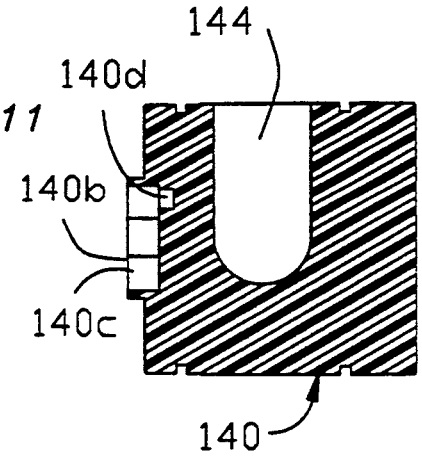
FIG. 11 is an enlarged cross-sectional view taken substantially along the line 11—11 of FIG. 8.

Viewing FIGS. 2, 8 and 11, it can be seen that the normally rearmost circular face 140*a* of rotor 140 has a cylindrical boss 140*b* extending therefrom and of substantially less diameter than that of the main body of the rotor. Boss 140*b* as well as the adjacent face 140*a* of rotor 140 is provided with an elongated recess 140*c* therein which extends across a significant part of the transverse extent of boss 140*b*. A circular cavity 140*d* is provided in the bottom of recess 140*c* at one end thereof.

A fluid pressure operated vane-type actuator 154 is bolted to the plate 28 of rotor compartment 24. The actuator 154 has an output shaft 156 which extends therethrough and projects outwardly from opposite faces thereof. The normally innermost end of shaft 156 is provided with flats which are received within a slot therefor in an actuating block assembly 158. As is best shown in FIG. 6, assembly 158 includes a rectangular block 160 which carries a projecting bolt 162 on the outer face thereof. Block 160 is sized to be received in the recess 140*c* in rotor 140 with the bolt 162, which acts as a polarity device, received in cavity 140*d*.

The actuator 154 is of the type where a vane (not shown) is reciprocable through a path of at least about 90° with valve means being provided for selectively directing air pressure to one side of the vane or the other side thereof to effect shifting of such vane between opposite ends of its path of travel. As the vane is caused to rotate back and forth, it turns the shaft 156 in opposite directions to shift assembly 158 and thereby rotate rotor 140 along an arcuate path of travel in opposite directions when the rotor is installed in compartment 24. A particularly useful vane-type actuator has been found to be a unit available from Matryx, Model No. 200.

Figure 12:
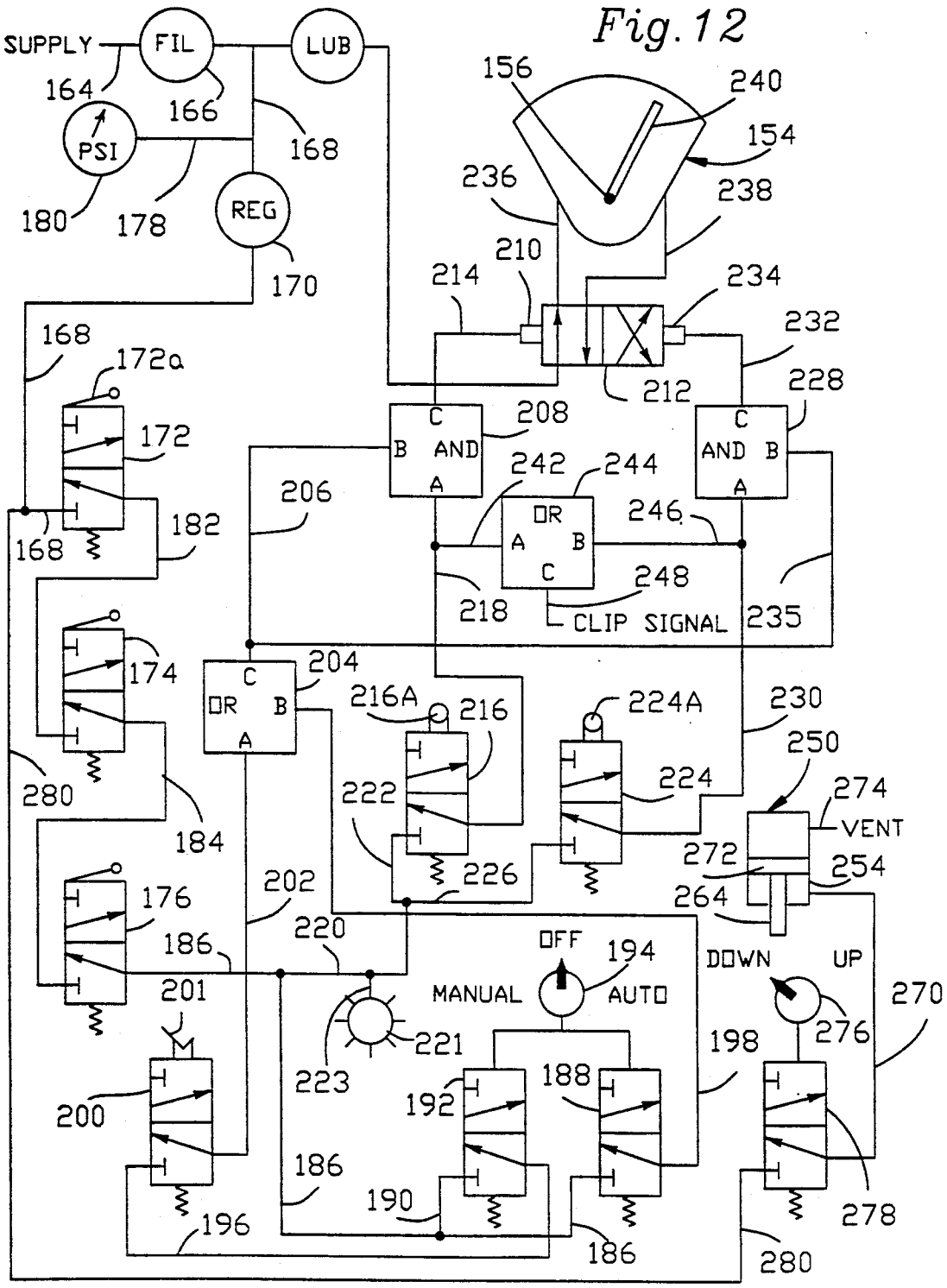
FIG. 12 is a schematic representation of the fluid control circuit controlling operation of the portioning mechanism.

A representative pressurized fluid operated control circuit for apparatus 20 is illustrated schematically in FIG. 12, wherein air at a nominal pressure of 100–120 psig is furnished via supply line 164. After passing through filter 166, line 164 connects to a main control line 168 having a pressure regulator 170 therein. The regulator is desirably set to allow fluid at a pressure of 80 psig to flow via line 168 to serially connected door ajar sensors 172, 174 and 176. Line 178 connected to line 168 between filter 166 and regulator 170 has a gauge 180 for providing a readout of the pressure in line 168.

Desirably, apparatus 20 has swingable doors across the front of frame 22, as well as across opposite sides thereof to provide ready access to the interior of the machine. The stationary rear wall of apparatus 20 through which shaft 130 extends, also mounts various control switches, the gauge 180 and fluid inlet and outlet ports. The door ajar safety sensors 172, 174 and 176 are strategically mounted to permit operation of the machine only if the sensors indicate that respective doors are in their closed positions. Thus, referring to sensor 172, the switch arm mounted roller device 172*a* is spring biased toward an open position whereby air is vented from line 182 to the atmosphere. This position of the switch is schematically indicated by the lower block of the sensor 172 representation of FIG. 12. However, and assuming that sensor 172 is associated with the front doors of apparatus 20, when those doors are closed, the device 172*a* is held in its closed position by door pressure thereby causing the fluid diverting elements of sensor 172 to shift and thereby bring the supply line 168 into fluid communication with fluid outlet line 182.

Sensors 174 and 176 operate in the same manner as sensor 172, with sensor 174 being associated with one set of doors on one side of the machine while sensor 176 is associated with the doors on the opposite side of the apparatus 20. Line 182 leads to the inlet of sensor 174 while fluid outlet line 184 leads to the inlet of sensor 176. It is to be noted from the fluid supply arrangement that the sensors 172, 174 and 176 are all in serial fluid flow relationship. As a consequence, fluid cannot flow from supply line 164 to the fluid outlet line 186 leading from sensor 176 unless all of the doors of apparatus 20 are in closed disposition.

Fluid outlet line 186 is connected to a fluid switching device 188. As is apparent from the diagram of FIG. 12, a number of different fluid switching devices, including device 188 as well as sensors 172, 174 and 176 are all shown in a similar schematic manner. Thus, the representation is intended to indicate that downstream fluid is vented in the lower block of the representation whereas fluid flow through the switching device is represented by the upper block of the diagram. The same depiction is used for the other fluid switching devices to be described in connection with the schematic of FIG. 12.

Supply line 186 is also connected via line 190 to fluid switching device 192. A manually controllable switch knob 194 mounted on the rear wall of apparatus 20 is movable into one of three positions. The central position of such rotor as illustrated in FIG. 12 is the "off" position. The "manual" of the rotor is associated with device 192 while the opposite "auto" position of control knob 194 is operably associated with control device 188. The schematic representation is intended to indicate that when the knob 194 is in the manual position, the device 192 is shifted such that fluid may flow therethrough via line 190 to fluid outlet line 196. Similarly, the schematic is intended to illustrate that when knob 194 is in the auto position, device 188 is actuated allowing fluid to flow from supply line 186 to fluid outlet line 198.

Outlet line 196 is connected to the inlet of a manually controlled switch device 200 having a foot actuator 201, that is in turn is connected via supply line 202 to the inlet marked "A" of a fluid switching device 204 which is the equivalent of an "OR" gate. Outlet line 198 of switching device 188 is connected to the inlet "B" of switching device 204. The outlet port "C" of OR switching device 204 is connected via fluid supply line 206 to the inlet port "B" of a fluid switching device 208. The "C" outlet port of device 208 is connected to the pilot 210 of a fluid control valve 212 by a line 214. The "A" inlet port of fluid switching device 208 is connected to a limit switch 216 by a line 218. Switching device 208 is of the type that may be designated an "AND" switch whereby fluid is permitted to flow through the outlet port C only if fluid pressure is supplied at both of the inlet ports A and B.

The limit switch 216 is located on cross member 96 as illustrated in FIG. 1, wherein it can be seen that the switch 216 is positioned such that the actuator 216*a* thereof is engaged by the uppermost flange 80*b* of cylinder 80. Upon shifting of switch actuator 216*a* by the flange 80*b*, the switching device 216 allows flow of pressurized fluid from line 222 to line 218. A signal light 221 connected to line 220 by line 223 is located on the rear panel of apparatus 20 and provides a visual indication that line 220 is pressurized thereby confirming that all of the doors associated with sensors 172, 174 and 176 are closed and that pressurized fluid is being supplied via line 164.

Another limit switch 224 similar to switch 216 is mounted on the lower cross member 98 in disposition such that the actuator 224*a* thereof is located to be engaged by the flange 82*b* of cylinder 82, again as best shown in FIG. 1. Line 226 supplies pressurized fluid from line 220 to the inlet of switching device 224 while the outlet thereof is connected to inlet port "A" of AND switching device 228 by a line 230. The "C" outlet port of switching device 228 is connected by line 232 to the pilot 234 of valve 212 which is opposed to pilot 210. Line 235 joins line 206 to the inlet "B" of AND switching device 228. Switching device 228 functions in a manner similar to AND gate 208 in that fluid flow is permitted through outlet C to valve 212 only if fluid pressure is available at both of the inlets A and B of device 228.

Fluid from valve 212 is supplied to opposite sides of the vane-type actuator 154 by a line 236 associated with pilot 210, or in the alternative by a line 238 associated with the pilot 234 of valve 212. When pressure is supplied to actuator 154 via line 236, the vane 240 is shifted to the right viewing FIG. 12, whereas when fluid pressure is directed into the interior of the actuator 154 through line 238, the vane 240 is rotated through a 90° displacement to the left as viewed in the schematic representation.

In the event apparatus 20 is used in association with a standard clip applying device operable to place a clip around a sausage casing or the like, apparatus 20 is optionally provided with means to initiate a "clip signal" directed to the clip mechanism. In that event, a line 242 is connected between the "A" inlet of switching device 244 and line 218. The "B" inlet port of switching device 244 is connected to line 230 by a line 246. The outlet port of device 244, which functions as an "OR" gate, is connected to the clip applying mechanism by a line 248. Device 244 allows pressurized fluid to flow through line 248 whenever fluid pressure is present at either of the inlet ports A or B.

Figure 10:
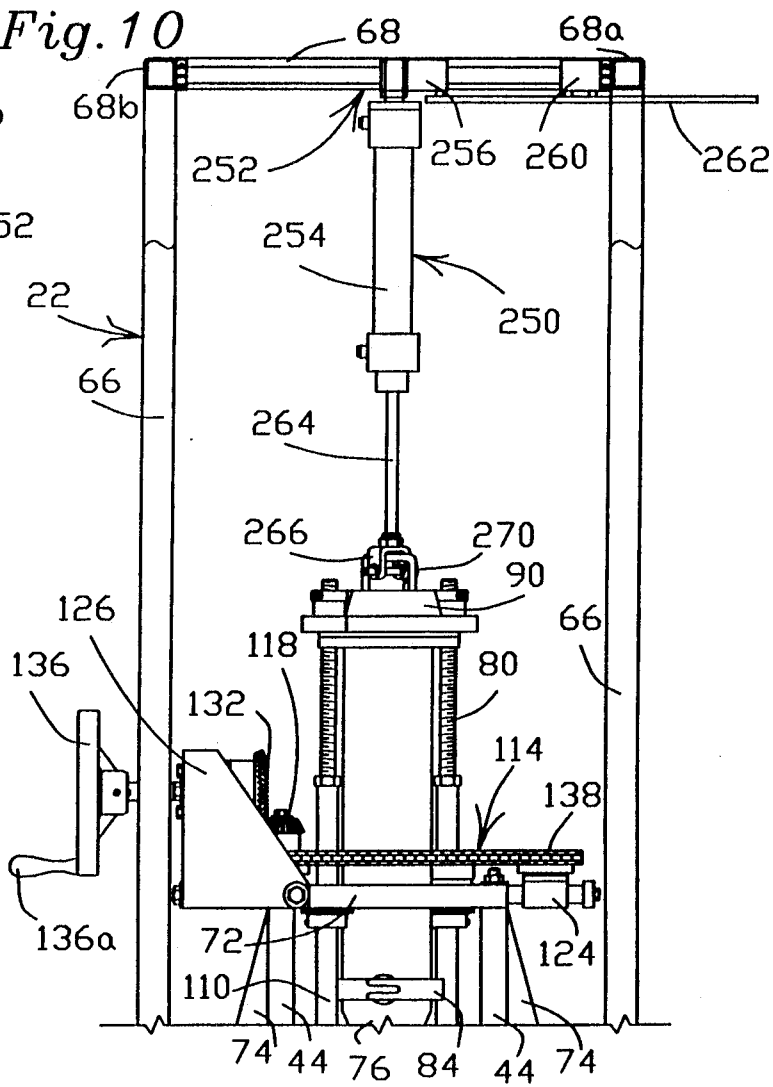
FIG. 10 is a fragmentary vertical cross-sectional view similar to FIG. 9 and showing another position of the mechanism which facilitates disassembly of operating components of the machine.
Figure 9:
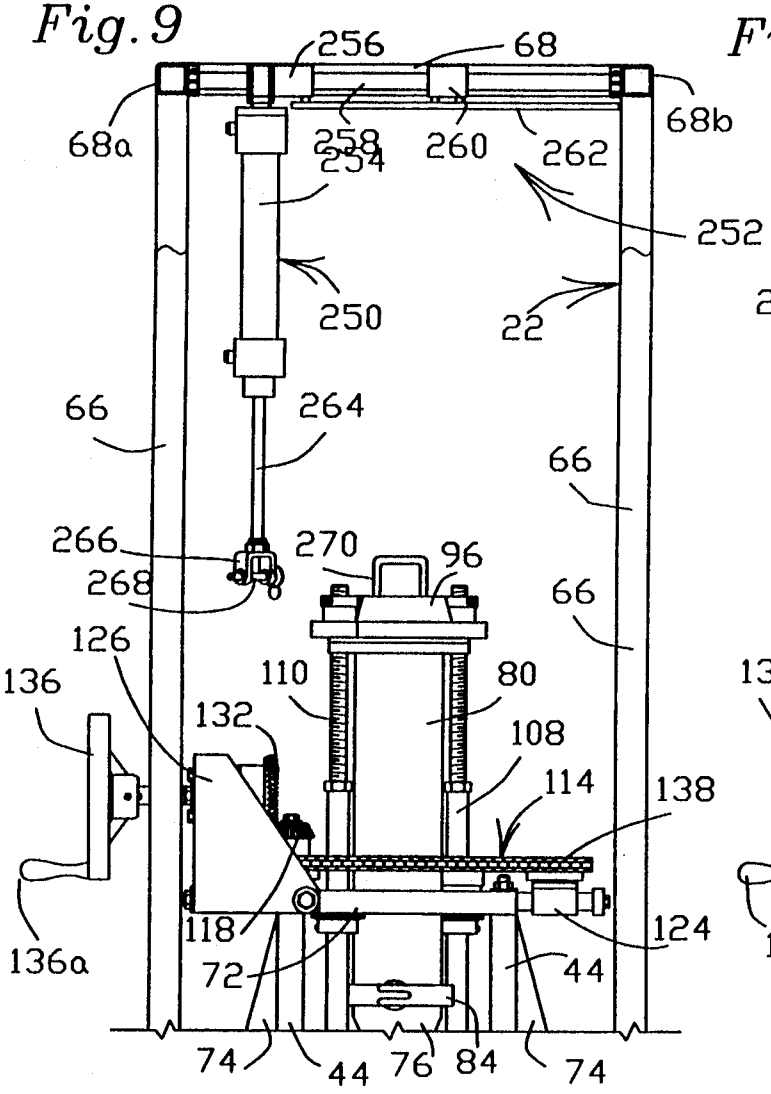
FIG. 9 is a fragmentary vertical cross-sectional view of the upper part of the machine as depicted in FIG. 2 and illustrating mechanism for facilitating disassembly of operating components of the machine for cleaning and/or repair purposes.

In order to facilitate removal of the cylinder 80 and associated piston 88 from the rotor compartment 234, a fluid actuated single acting piston and cylinder assembly 250 is suspended from a track unit 252 located at the uppermost end of the frame 22 (see particularly FIGS. 1, 9 and 10). The cylinder 254 of assembly 2552 abuts a sleeve component 256 slidably mounted on a horizontal rod 258 extending fore and aft of frame 22 in alignment with the frame elements 68 and extending between the front frame element 68*a* and the rear frame element 68*b*. Another sleeve component 260 is also slidably mounted on rod 258 ahead of the sleeve 256. An slidably mounted on rod 258 ahead of the sleeve 256. An elongated bar 262 in underslung relationship to rod 258 and parallel therewith, is secured to both of the sleeve components 256 and 260.

As is evident from FIGS. 9 and 10, the cylinder depends from the track unit 252, which is located midway between the frame elements 68*c* and 68*d*, such that the piston rod 264 of cylinder 254 provided with a clevis 266 on the lowermost extremity thereof may be moved into substantially direct axial alignment with the cylinder 80. A removable pin 268 on clevis 266 is adapted to be positioned within an upstanding hook 270 secured to and projecting upwardly from the upper part of cross member 96 as shown in FIG. 1.

Returning to the schematic representation of FIG. 12, the piston and cylinder assembly 250 is shown schematically in the lower right-hand corner of that figure. As indicated in such representation, fluid pressure is supplied to the lower part of cylinder 254 by a supply line 270. Air within cylinder 254 above piston 272 on rod 264 is vented to the atmosphere via port 274. A manually controllable knob 276 accessible from the rear panel of apparatus 20 is operably connected to a fluid switching device 278. The line 270 is connected to the outlet port of the switching device 278. Pressurized fluid is supplied to the inlet of switching device 278 via line 280 connected to line 168 upstream of the sensor 172. As indicated in the lower right-hand corer of FIG. 12, knob 276 is movable between an "UP" position where the piston 272 of piston and cylinder assembly 250 is retracted, and a "DOWN" position as illustrated in FIG. 10.

Operation

In explaining an exemplary operation of apparatus 20, it is initially assumed that the machine is intended to package a flowable product such as sausage in suitable casings. A typical high volume product in this respect is a three pound sausage.

Accordingly, the tube 52 is connected to a suitable supply line for the flowable comminuted meat product. A casing horn 56 is also mounted on the delivery tube 54. In this manner, a sausage casing, suitably clipped at one end may be telescoped over the outermost end of the horn 56. When the comminuted meat or other flowable product is forced into tube 52 under pressure, the meat moves through the passage 142 or 144 aligned with tube 52 into a respective cylinder 82 or 80. If the rotor 140 is in the position illustrated in FIG. 2 and the pistons 88 and 90 are approaching the disposition shown in that depiction, movement of the mounting bar 96 to the lower end of its path of travel whereby flange **80*b* engages actuator 216*a* to depress such actuator, the limit switch 216 brings line 222 into fluid communication with line 218. Thus, assuming that all of the doors are closed and that control knob 194 is in the manual position thereof causing switch 192 to be closed, pressurized fluid may flow to actuator 154 to rotate rotor 140, only after limit switch 216 has been actuated to provide pressurized fluid to port A of AND gate 208 and the operator depresses foot control 201 to close switch 200 and thereby supply pressurized fluid to port B of AND gate 208 through OR gate 204. Thus, pressurized fluid from supply line 164 may flow via line 168 through regulator 170, line 182, line 184, line 186, line 222, line 218 and line 214 to the pilot 210 of valve 212. Pressurized fluid supplied to actuator 154 via pilot 210 swings vane 240 through a displacement such that rotor passage 140 intercommunicates the inlet tube 52 and the bottom of cylinder 80. At the same time, the passage 142 intercommunicates the top of cylinder 82 and the horn 56**.

As the flowable product is delivered under pressure into the bottom of cylinder 80, piston 88 and its associated rod 92 are moved upwardly viewing FIG. 1 to thereby at the same time lift cross member 96 and the connecting rods 108 and 110 joined thereto. Because the rods 108 and 110 are also connected to the lower cross member 98, the piston rod 94 and associated piston 90 are raised in cylinder 82 causing flowable product that has previously accumulated in the chamber defined by cylinder 82 to be displaced from the cylinder into horn 56 via passage 142. Also appreciating that the passage 142, tube 54 and horn 56 were filled with flowable product from a prior cycle at the time the comminuted meat is displaced from cylinder 82 by piston 90, the amount of comminuted meat ejected from the outer orifice of horn 56 is a function of the volume of meat moved upwardly in cylinder 82 by the piston 90. In like manner, the amount of comminuted product received in cylinder 80 as the piston 88 is displaced by flowable product being forced into cylinder 80 via supply tube 52, is a function of the displacement volume of cylinder 80.

Figure 5:
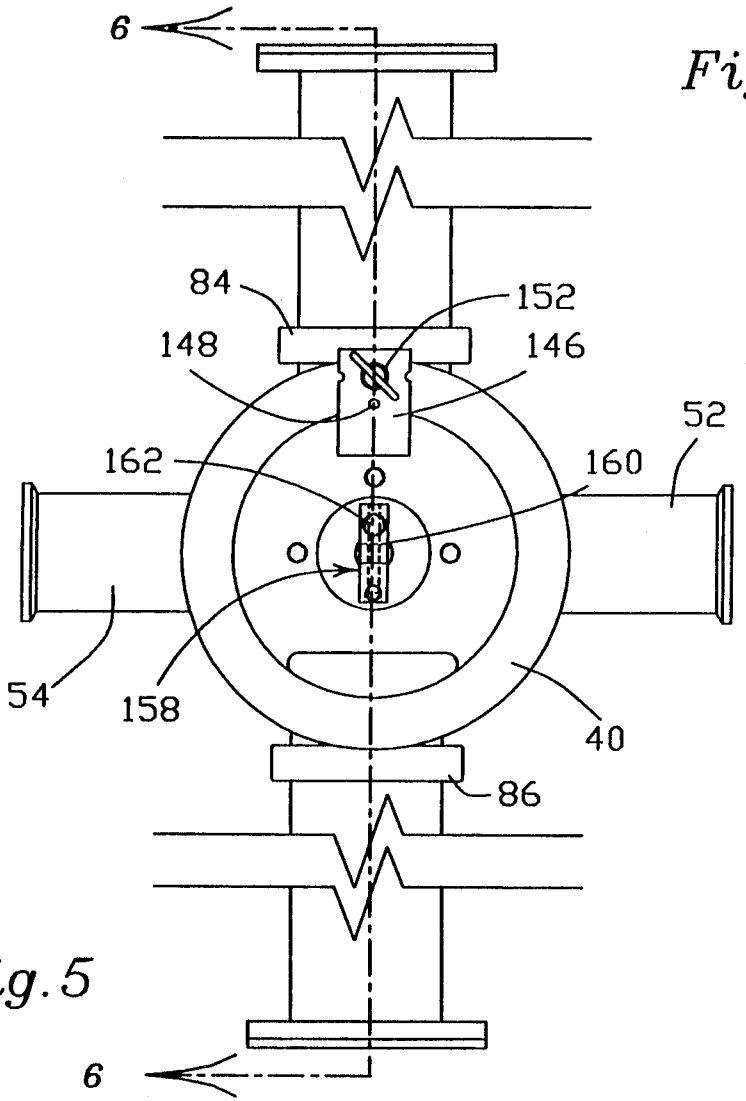
FIG. 5 is an enlarged fragmentary front elevational view of the central part of the machine as illustrated in FIG. 1 but with the distribution rotor removed to better illustrate the compartment for receiving the rotor.

The supply of flowable product to cylinder 80 continues until mounting bar 98 has been raised to engage flange **82*b* (see FIGS. 5–6), thereby depressing the actuator 224*a* of switching device 224 thereby so as to bring line 226 into fluid communication with line 230. However, the rotor 140 is not rotated to communicate tube 52 with cylinder 82 until the operator again depresses foot actuator 201 thus providing fluid pressure at ports A and B of AND gate 228 so that fluid pressure may flow through port C of gate 228 to the pilot 234 of valve 212. When flow of pressurized fluid through AND gate 228 occurs, vane 240 of actuator 154 is rotated in the opposite direction to rotate the rotor 140**.

Before the operator depresses foot actuator 201 to initiate another cycle of operation of apparatus 20, the casing filled with flowable material and that was placed over horn 56 is removed and the opened end sealed with a suitable clip or the like. Another casing is then slipped over the outermost end of the horn 56. When this has been accomplished, the foot actuator 201 is depressed to permit movement of the pistons 90, 88, as cylinder 82 is filled with the flowable product and comminuted meat is displaced from cylinder 80 to the horn 56.

The cyclic operation described above is continued until the required amount of sausage casings have been filled. It is important to take note of the fact that the present apparatus permits portioning of the flowable meat product into more precise portions than has previously been possible with machines of this type. Whereas before, the portions had a weight tolerance of $\pm 3.5$ grams, the present apparatus allows utilization of a tolerance factor of only $\pm 2.5$ grams. In a case where the sausage or other meat product is to be sold at a fixed price rather than on a per unit weight basis, the operator of the apparatus 20 realizes a significant saving by virtue of the fact that a $+2.5$ gram tolerance as contrasted with a previously required $+3.5$ gram tolerance results in a net saving of 1 gram per sausage. At $3.00 per pound, considering the fact that it is not unusual for machines to process many thousands of pounds a day, significant savings are realized.

In the automatic operation of apparatus 20 whereby knob 194 is moved to the "auto" position, the rotor 140 is rotated by actuator 154 each time the limit switch 216 or in the alternative the limit switch 224 are actuated by the cross members 96 and 98 respectively. Similarly, if the apparatus is provided with the optional clip signal mechanism, that signal will be provided at the outlet port C of OR gate 244 each time a limit switch is closed.

During operation of apparatus 20, the portion of flowable product delivered from the outlet tube 54, whether it be to a horn 56 or other appropriate conduit, is precisely the same during each cycle of operation. If for any reason the operator of the apparatus desires to change the weight of the portions delivered from the outlet tube 54, the portion may be changed while the machine is in operation. This change in the amount of flowable product may be accomplished by simply rotating control hand wheel 136 on the rear of the machine. Turning of wheel 136 causes rotation of bevel gear 132 thereby rotating gear 118 to move endless chain 138 in one direction of travel or in the opposite direction depending on the direction of turning of the wheel 136. Movement of the chain 138 causes the sprockets 116 to be rotated thereby rotating rods 108 in either a clockwise or counterclockwise direction depending on the direction of turning of the wheel 136. By virtue of the fact that the rods 108 and 110 are oppositely threaded at the upper and lower extremities thereof, rotation of rods 108 and 110 causes the cross members 96 and 98 to either be moved toward one another, or away from each other. Furthermore, the threads on rods 108 and 110 are the same so that cross members 96 and 98 always move the same distance relative to the axis of rotor 140. In the case of certain meat products, however, portion changes during operation may be difficult because of back pressure developed during operation. In these instances, the machine is stopped and adjustment made of the relative positions of the cross members 96 and 98 to vary the volumes of the meat receiving chambers presented by cylinders 80, 82 and corresponding pistons 88, 90.

In order to clean up apparatus 20 at the conclusion of the operation thereof, the rotor 140 may be pulled out of the compartment 24 by simply moving the retainer plate 146 to a position clearing the rotor, thus allow removal of rotor 140 by pulling outwardly on handle 282.

In like manner, cylinder 82 and its associated piston 90 and rod 94 may be uncoupled from compartment 24 by simply removing the releasable lower clamp 86 accompanied by disconnection of the eye 100 from tabs 102 and 104 on cross member 98.

In order to assist in removal of cylinder 80, the piston and cylinder assembly 250 is shifted into overlying relationship to cylinder 80 and knob 276 is rotated into the down position thereby venting cylinder 254 to the atmosphere via vent 274 so that the piston 272 may be drawn downwardly to bring clevis 266 to the level of cross member 96. The piston and cylinder assembly 250 with the piston rod 264 in its lowered position is then brought forwardly of the frame 22 until clevis 266 is adjacent hook 270. Upon removal of the pin 268 from the clevis 266 and then replacement in the clevis after the pin is inserted into the hook 270, the piston and cylinder assembly 250 is mechanically coupled to upper cross member 96.

The releasable clamp 84 is removed from the upper cylinder 80 and control knob 276 is turned to the up position, thereby closing switching device 278 to supply pressurized fluid to the piston side of cylinder 254 via line 168, line 280 and line 270. Raising of the piston 254 lifts the cross member 96, piston rod 92 and piston 88 to a level so that the cylinder 80 may then be swung outwardly into disposition such that upon disconnection of rod 92 from cross member 96, the cylinder 80 and piston and rod assembly 88, 92 may be removed from the frame 22.

The bar 262 forming a part of track unit 252 extends outwardly from frame 22 when the piston and cylinder assembly 250 overlie cylinder 80, as is illustrated in FIG. 10, so that the front doors of apparatus 20 cannot be closed thus closing sensor switch 172, while the cylinder 254 is in its outer position.

In one set of tests wherein nominal three pound sausage portions were delivered and stuffed, the apparatus of the present invention using the manual operation mode described above gave excellent; highly reproducible results. Specifically, in order to obtain 99% of the portions having a weight of three pounds or above, the "give-away" loss factor using the portioner of the present invention was only 0.28 ounces per portion. If it is assumed that the sausage product has a value to the processor of $3.00 per pound, this calculates to a give-away loss of only $1.74 per hundredweight. In a similar test, use was made of the portioner of the invention on automatic control as described above, in conjunction with a CMZ mechanical casing feeder. The use of this combined system would predictably lead to greater give-away losses, because of the operational characteristics of the CMZ machine. In fact, it was determined that the give-away factor needed to obtain 99% of the portions three pounds and above was 0.83 ounces per portion, or $5.10 per hundredweight using the $3.00 per pound assumption above. Finally, another series of tests was performed using a competitive portioner in conjunction with the CMZ machine. This test established a give-away factor of 1.95 ounces per portion to obtain 99% three pounds and above, or $11.70 per hundredweight based upon a $3.00 per pound product value. Accordingly, the portioner of the present invention gave a 56% improvementin give-away losses ($6.60/$11.70×100).

We claim:

1. In apparatus for successfully supplying substantially equal portions of a flowable product from a source thereof to a delivery zone, the improvement comprising:

a compartment adapted to be connected to said product source and to the delivery zone respectively;

mechanism communicating with the compartment defining dual product-receiving chambers, said mechanism including a cylinder defining each of the chambers, each of said cylinders having volume-altering means therein for alternately and correspondingly decreasing the effective product-receiving volume of one chamber as the effective product-receiving volume of the other chamber increases, and vice versa, said volume-altering means including a piston in each of said cylinders movable through a displacement to vary the effective product-receiving volume of a respective cylinder;

means in the compartment for directing product received from said source inlet into one chamber while the volume thereof increases, and for simultaneously directing product from the other compartment to the product delivery outlet as the volume of said other compartment decreases; and means externally of the compartment and said chambers and connected to each of said pistons for substantially equalizing the increase and decrease of the effective product-receiving volume of each of the chambers.

2. In apparatus as set forth in claim 1, wherein said chamber volume equalizing means includes means for selectively adjusting the effective maximum and minimum product-receiving volumes of the chambers.

3. In apparatus as set forth in claim 1, wherein said adjustment means includes components for varying the effective maximum and minimum product-receiving volumes of the chambers during simultaneous increase and decrease of the volumes thereof.

4. In apparatus as set forth in claim 1, wherein said product-directing means in the compartment comprises a rotor having passage means therein disposed to communicate the inlet with one chamber while the other chamber communicates with the delivery outlet when the rotor is in one rotational position thereof, and for communicating the inlet with the other chamber while said one chamber communicates with the delivery outlet when the rotor is in a second rotational position thereof.

5. In apparatus as set forth in claim 4, wherein is provided means for rotating the rotor between said positions thereof in synchronization with maximum increase and decrease in the effective product-receiving volumes of said chambers.

6. In apparatus as set forth in claim 1, wherein said cylinders are disposed in opposed, generally axially aligned tandem relationship.

7. In apparatus as set forth in claim 6, wherein said external chamber volume equalizing means includes rod means external of the cylinders extending between opposed end extremities of the cylinders and connected to opposed pistons for causing simultaneous movement thereof within respective cylinders.

8. In apparatus as set forth in claim 7, wherein said rod means includes an elongated cross member at opposed ends of the tandem positioned cylinders, and a pair of rods extending between respective cross members on opposite sides of the tandem cylinders.

9. In apparatus as set forth in claim 8, wherein is provided means for shifting the members toward and away from one another to adjust the extent of the path of movement of the pistons within respective cylinders.

10. In apparatus as set forth in claim 9, wherein said rods extending between respective cross members are each oppositely threaded along the length thereof with one length of thread of each rod being threaded into one member while the other length of thread of each rod is threaded into the opposite member whereby rotation of the rods in the same direction causes the members to be moved toward and away from one another, said adjustment structure including means for simultaneously rotating the rods in one direction of rotation to move the members toward one another and for rotating the rods in the opposite direction of rotation to shift the members away from one another.

11. In apparatus as set forth in claim 10, wherein said adjustment structure includes a sprocket operatively connected to each of the rods for rotating the latter, an endless chain trained around each of the sprockets, and gear means accessible externally of the apparatus for rotating one of the sprockets to effect rotation of both thereof to rotate the rods and thereby move the members toward and away from another.

12. In apparatus as set forth in claim 7, wherein is provided means for releasably coupling the cylinders with the compartment, the pistons being removable from respective cylinders, and the product directing means in said compartment being removable from the compartment for cleaning of the cylinders, pistons, product directing means, and compartment.

13. In apparatus as set forth in claim 12, wherein said cylinders are oriented for movement of the pistons therein along generally axially aligned paths of travel, there being means for supporting one of the pistons and the rod means while the associated cylinder is being disconnected from the compartment for cleaning of such cylinder and the piston therein.

14. A method for successively supplying substantially equal portions of a flowable product from a source thereof to a delivery zone, said method including the steps of:

applying said flowable product to a central compartment;

directing flowable product from the compartment into a first cylinder which has a moveable first piston therein defining a first chamber, said first piston being moveable in a direction to permit the progressive increase in the volume of said first chamber while material is being directed to the first cylinder, until a predetermined maximum volume is reached;

directing flowable product from the compartment into a second cylinder which has a moveable second piston therein defining a second chamber, said second piston being moveable in a direction to permit the progressive increase in the volume of said second chamber while material is being directed to the second cylinder, until a predetermined maximum volume is reached;

causing the volume of the first chamber to decrease from said maximum volume thereof to a minimum volume, as the volume of the second chamber increases to said maximum volume thereof;

causing the volume of the second chamber to decrease from said maximum volume thereof to a minimum volume, as the volume of the first chamber increases to said maximum volume thereof;

said product being alternately directed into a respective chamber as the volume thereof increases, and alternately being delivered from each chamber as the volume thereof is caused to decrease;

directing product delivered from a corresponding chamber during decrease of the volume thereof through the compartment to said delivery zone; and controlling the movement of the first and second pistons to increase and decrease the volume of the first and second chambers from pints externally of the chambers to cause the increase in volume of one chamber to be directly proportional to the decrease in the volume of the other chamber, and vice versa.

15. In a method as set forth in claim 14, wherein is included the step of sensing the increase in volume of respective chambers and to effect initiation of decrease of the volume of a corresponding chamber when the volume thereof has reached said predetermined maximum volume.

16. In a method as set forth in claim 14, wherein is included the step of manually controlling the time interval which elapses between each cycle of increase and decrease of the volumes of respective chambers.

* * * * *